US009920534B2

(12) United States Patent
Albert

(10) Patent No.: US 9,920,534 B2
(45) Date of Patent: Mar. 20, 2018

(54) INTEGRATED SUPPORT SYSTEM AND CANOPY

(71) Applicant: D8 Products, Inc., Frederic, WI (US)

(72) Inventor: Ned H. Albert, Frederic, WI (US)

(73) Assignee: D8 Products, Inc., Frederic, WI (US)

( * ) Notice: Subject to any disclaimer, the term of this patent is extended or adjusted under 35 U.S.C. 154(b) by 0 days.

(21) Appl. No.: 15/617,570

(22) Filed: Jun. 8, 2017

(65) Prior Publication Data

US 2017/0362832 A1 Dec. 21, 2017

Related U.S. Application Data

(60) Provisional application No. 62/352,802, filed on Jun. 21, 2016.

(51) Int. Cl.
*E04F 10/00* (2006.01)

(52) U.S. Cl.
CPC ..... *E04F 10/005* (2013.01)

(58) Field of Classification Search
CPC ..... E04F 10/005; E04B 1/003; E04B 1/0038; E04B 1/35; E04B 2001/2415; A01G 2017/065; A01G 17/06; A01G 9/12; Y10T 403/42; Y10T 403/46; Y10T 403/4602; Y10T 403/4691; Y10T 403/4642; Y10T 403/4645; Y10T 403/73; E04H 15/32; E04H 15/34; E04H 15/44
USPC ..... 52/73–75, 78, 283, 289, 653.2, 654.1, 52/655.1, 702; 248/228.7, 201, 220.1, 248/220.22, 316.8; 47/47, 70; 135/121–122, 120.3
See application file for complete search history.

(56) References Cited

U.S. PATENT DOCUMENTS 4,125,973 A * 11/1978 Lendrihas ..... E04L 31/165 249/188
4,205,497 A * 6/1980 Schirm ..... C07F 7/123 52/241
4,464,074 A * 8/1984 Green ..... E04B 1/2403 211/182

(Continued)

OTHER PUBLICATIONS

Definition of "Trellis;" https://www.thefreedictionary.com/trellis (last accessed on Dec. 25, 2017). (Year: 2017).*

*Primary Examiner* — Theodore V Adamos
(74) *Attorney, Agent, or Firm* — Patterson Thuente Pedersen, P.A.

(57) ABSTRACT

A trellis system having a trellis structure that is installable to extend generally outwardly from a vertical supporting member. The trellis structure includes at least one internal mounting bracket by which the trellis structure is securable to the vertical supporting member. The internal mounting bracket has a unitary member having a flange portion and a web portion, the flange portion being securable to the vertical supportable member by fasteners and the web portion extending outwardly orthogonally from the flange portion and being couplable to one of the plurality of outwardly extending tube structures. A tube structure has a flange opening and a front opening sized to receive the web portion. The web portion passes through the front opening. The web portion has an alignment structure sized to be received within one of the outwardly extending tube structures in close fitting relation to an interior of the outwardly extending tube structure.

16 Claims, 6 Drawing Sheets

(56) References Cited

U.S. PATENT DOCUMENTS

| | | | | | |
|---|---|---|---|---|---|
| 5,289,665 | A * | 3/1994 | Higgins | E04B 1/2403 | 211/191 |
| 5,342,138 | A * | 8/1994 | Saito | E04B 1/2604 | 403/187 |
| 5,425,203 | A * | 6/1995 | Scott | A01G 9/12 | 403/171 |
| 5,483,773 | A * | 1/1996 | Parisien | E04B 1/003 | 52/299 |
| 5,680,737 | A * | 10/1997 | Sheipline | E04B 1/24 | 403/169 |
| 5,829,908 | A * | 11/1998 | Slowbe | E04B 1/2403 | 403/230 |
| 5,901,523 | A * | 5/1999 | Tasi | A47B 57/54 | 248/223.41 |
| 6,032,431 | A * | 3/2000 | Sugiyama | E04B 1/2604 | 403/230 |
| 6,082,070 | A * | 7/2000 | Jen | E04B 1/24 | 403/170 |
| 6,402,414 | B1 * | 6/2002 | Kanodia | B62D 23/005 | 296/205 |
| 7,310,920 | B2 * | 12/2007 | Hovey, Jr. | E04B 1/24 | 52/282.1 |
| 8,689,516 | B2 * | 4/2014 | Richardson | B62D 27/023 | 156/79 |
| 8,695,815 | B2 * | 4/2014 | Takahashi | H05K 7/1432 | 211/182 |
| 9,422,711 | B1 * | 8/2016 | Hendry | E04B 1/2403 | |
| 2014/0013701 | A1 * | 1/2014 | Rodgers | E04B 1/38 | 52/698 |
| 2015/0315777 | A1 * | 11/2015 | Broughton | E04B 1/40 | 52/289 |

* cited by examiner

INTEGRATED SUPPORT SYSTEM AND CANOPY

CROSS-REFERENCE TO RELATED APPLICATIONS

The present application claims the benefit of U.S. Provisional Application No. 62/352,802, filed Jun. 21, 2016, entitled "Integrated Support System and Canopy," which is hereby incorporated herein in its entirety by reference.

TECHNICAL FIELD

The invention generally relates to a building trellis, canopy, outdoor dining cover, sunshade or overhang, and installation of the trellis, canopy, outdoor dining cover, sunshade or overhang system on a building. More particularly, the invention is directed to a trellis, canopy, outdoor dining cover, sunshade or overhang structure that is attached to the exterior of a building thus achieving an aesthetically pleasing appearance as well as protection from the elements.

BACKGROUND

The exterior of a building can be modified with an awning, trellis, canopy, outdoor dining cover, sunshade or overhang structure to provide the building with additional exterior coverage as well as protection for windows and persons passing into and out of the building. The awning, trellis, canopy, outdoor dining cover, sunshade or overhang can provide additional shade to the building and to the area underneath the awning, trellis, canopy, outdoor dining cover, sunshade or overhang, as well as protection from the elements such as rain, snow, ice and sun. Canvas awnings that roll-up are popularly used for store fronts and restaurants, to provide shade, protection from the rain, and can be aesthetically appealing to consumers. Generally, a winding device is used to roll/fold these canvas awnings into place against the building front when the awning is no longer desired. These canvas awnings are not designed to withstand severe weather; heavy snow, rain or wind, and are more a decorative shade-providing device with limited durability. Canvas awnings have a short life and need frequent replacement.

However, some awnings are made from metal, such as aluminum, and are generally sturdier than the canvas awnings, and can also be folded away when no longer desired. These types of awnings generally slope away from the building such that any rain, snow or ice slides off the edge of the awning where it may fall onto visitors to the building or onto pavement where, in freezing weather conditions, ice may form creating a safety hazard. Further, these awnings generally have many parts, are time-consuming to install, and have aesthetically unpleasing exposed fasteners.

Some buildings can have a trellis, canopy, outdoor dining cover, sunshade or overhang attached to the side of the building. Oftentimes the trellis, canopy, outdoor dining cover, sunshade or overhang is attached to the side of the building and the roof of the trellis/overhang is supported by columns or posts. Others are supported by a series of turnbuckles or other structure which extends from an outer edge of the trellis diagonally to the side of the building above the trellis which may also utilized to level the trellis structure. Generally, the trellis comprises a number of flat panels made of metal, plastic or wood. Also, a trellis/overhang constructed with posts supporting the roof of the trellis/overhang is subject to cars and people running into the posts. The posts may be especially prone to be damaged if the trellis/overhang is attached to a business, such as a bank with a drive-up window. Drivers of cars may misjudge distances and damage the posts.

Aesthetically, the presence of diagonal turnbuckle supports may be aesthetically unpleasing or impractical in some applications. In some building designs the use of diagonal turnbuckle supports may be limited because the building has limited or non-existent points available for attachment of the upper end of the support.

Trellises can be built on the basis of a cantilever. However, this requires a beam that extends into the building twice the distance of the external extension. In many building designs this is impractical.

Accordingly, there is still room for improvement in a trellises, awnings or overhangs.

SUMMARY

According to example embodiments of the invention, a trellis system includes a frame structure and mounting structures. The frame structure includes front tubes, back tubes, end tubes and center tubes. The mounting structures are securable to a vertical structure.

The mounting structures include end mounting structures and center mounting structures. The center mounting structures may be of two types. According to a first embodiment of the invention, the center mounting structure includes a mounting bracket and a spacer sized to be received inside the center tubes. According to another example embodiment of the invention, an end mounting bracket includes an end spacer shaped and sized to be inserted into the end tubes in close fitting apposition to the interior of the end tubes.

According to example embodiments of the invention, the back tube, if present, includes a number of openings defined therein. A flange opening is sized to receive a flange portion of the center mounting structure therein and therethrough. The flange opening is formed in the back wall of the back tube. A web opening is formed in the front wall of the back tube and includes a vertical slot shaped opening and, in some example embodiments, a horizontal slot as well. The vertical slot and horizontal slot, if present, are sized to receive a web portion of the center mounting structure therethrough. The web portion of the center mounting structure is then secured to center tubes and aligned with the center tubes via either a spacer or a top or bottom mounting plate portion depending upon the embodiment of the invention. The back tube also may include fastener openings through the front wall of the back tube.

Embodiments of the invention disclosed herein eliminate the need for posts and/or angle braces being utilized in the hanging a trellis structure.

Embodiments of the invention are directed to a trellis, canopy, outdoor dining cover, sunshade or overhang for mounting to the side of a building. The structure can be variously referred to as a trellis, an overhang, an awning, a canopy or a sunshade. Hereinafter, the term trellis will be used for the inventive structure. Generally, the trellis is made of metal, for example, aluminum; however other materials can be used in constructing the trellis.

According to one example embodiment of the invention, the trellis is secured to the building with posts or angled supports and meets stringent requirements for snow loads and wind loads. The trellis does not require posts or columns to support the roof nor does the inventive trellis require turnbuckles and fasteners affixing the back tube affixing the trellis to the building to provide necessary support.

According to one example embodiment of the invention, an internal drain channel receives and channels draining precipitation so that water that leaves the trellis exits at a desired location that does not affect visitors under the trellis and minimizes creation of a safety hazard.

According to another example embodiment of the invention, the trellis system includes an internal drain system that drains water from precipitation that would otherwise accumulate on the infill panels and drain off the edge of the trellis to an undesired location. The internal drain system is effective while not presenting any unsightly external drain structure. The internal drain system of an embodiment of the invention redirects water from precipitation to a location away from visitors to the building, automobiles that may pass under the trellis and into areas where it is less likely to create a slip and fall hazard in freezing temperatures when the precipitation may freeze.

According to an example embodiment of the invention, the infill panels are coupled to a tube member of the trellis. Infill panels may include open or closed panels or may include louvers. In different embodiments of the invention, the tube member to which the infill panels are coupled and toward which the infill panels drain is the front tube member, the back tube member or even a side tube member. The tube members may have a cross section that includes completely rectangular or square or round tubes or may be partial tubes having a generally C-shaped cross-section. The infill panels are coupled to the tube member via multiple drain slots or by a continuous drain slot by which precipitation drains from the lower edge of the infill member into an internal channel via a drip edge. The internal channel is then appropriately sloped to drain water from precipitation to a desired location where it drains from the tube member.

According to an example embodiment of the invention, the channel, when viewed in cross-section, includes a short side, a tall side and a bottom. The channel may be formed from any substantially rigid water resistant material such as metals or polymers. The channel is conveniently formed as an extrusion having a cross section as described above or may be made from formed materials. Alternately, the drain channel can have a symmetrical cross section.

According to an example embodiment of the invention, the tall side of the channel is located at the outside aspect of the tube member while the short side of the channel is located at the inside aspect of the tube member adjacent the wall which abuts the infill panel. According to an example embodiment of the invention, the short side of the channel displays a short side flange while the long side of the channel presents a long side flange. The short side flange and long side flange are adapted to couple to the inside the tube member to allow the channel to be secured with an appropriate down slope to direct the drainage of water to a desired location via which it can then drain from the tube member. The short side of the channel is advantageous in that it permits the sloping of the channel to drain appropriately while not obstructing the drainage slots and permitting water to pass from the downward edge of the infill panel through the drain slots into the channel so that it can drain away.

According to different embodiments of the invention, the drain locations may be conveniently at outer corners of the trellis and outer ends of the front tube member so that water is directed away from for example a doorway entry. According to another embodiment of the invention, the drain locations may be made at wall side corners of the trellis system so that water that drains can be directed to a downspout. According to one example embodiment of the invention, the downspout is located internal to the building and joins the building drains from a flat roof that also drains internal to the building. According to another embodiment of the invention, the internal channel is coupled to the interior of the tube member by the application of an adhesive sealant.

Accordingly, water from precipitation that comes to rest on top of the infill panels drains down the slope of the infill panel toward one or more drain openings which then allow passage to the interior of the tube member, water then flows into the drain slots into the channel to its lower end to a drain hole either at one end of the tube member or to a downspout or other passage to which the water drain can be directed with other precipitation to a desired draining location. Water can also be directed around a corner to an adjacent member having a drain outlet.

A wall to which the mounting structures of the invention are attached generally will include internal wall supporting members and/or blocking to which the mounting structures are attachable by fasteners or other known techniques. The mounting structures also may be integrated into the wall structure and be within the scope of the invention.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
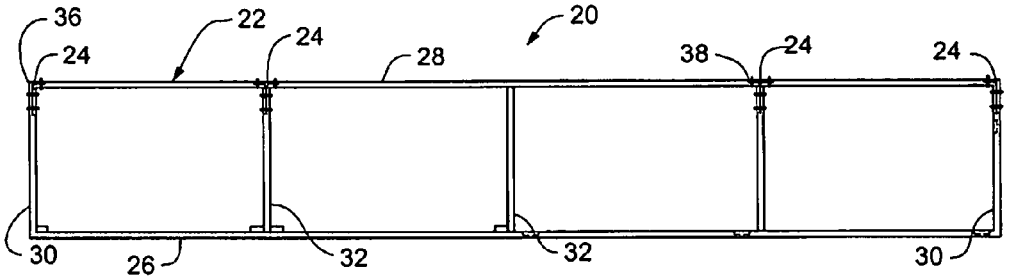
FIG. 1 is a plan view of a trellis system according to an example embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Referring to FIG. 1, trellis system 20 generally includes frame structure 22 and mounting structures 24. In the depicted example embodiment, frame structure 22 generally includes front tube 26, back tube 28, end tubes 30 and center tubes 32. Frame structure 22 and mounting structures 24 may be formed from aluminum, aluminum alloys, steel or other materials of sufficient strength and rigidity to perform the structural requirements.

Figure 2:
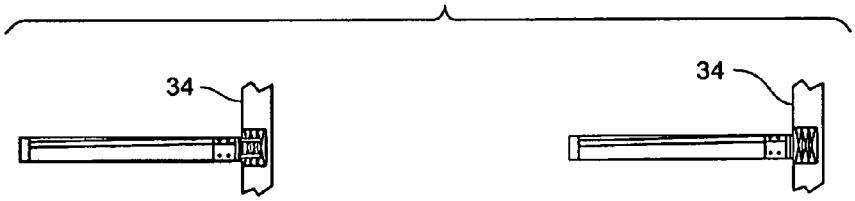
FIG. 2 is an elevational view of the trellis system of FIG. 1 as attached to a structure.

Referring to FIGS. 1 and 2, back tube 28, when installed, abuts vertical structure 34. End tubes 30 extend outwardly away from back tube 28 generally in a horizontal orientation. Center tubes 32 also extend outwardly away from back tube 28 in a generally horizontal orientation and abut front tube 26 which is secured to end tubes 30 and center tubes 32 by fasteners, welding or other known techniques.

Referring now to FIGS. 3-7, mounting structures 24 generally include end mounting structures 36 and center mounting structures 38.

Figure 3:
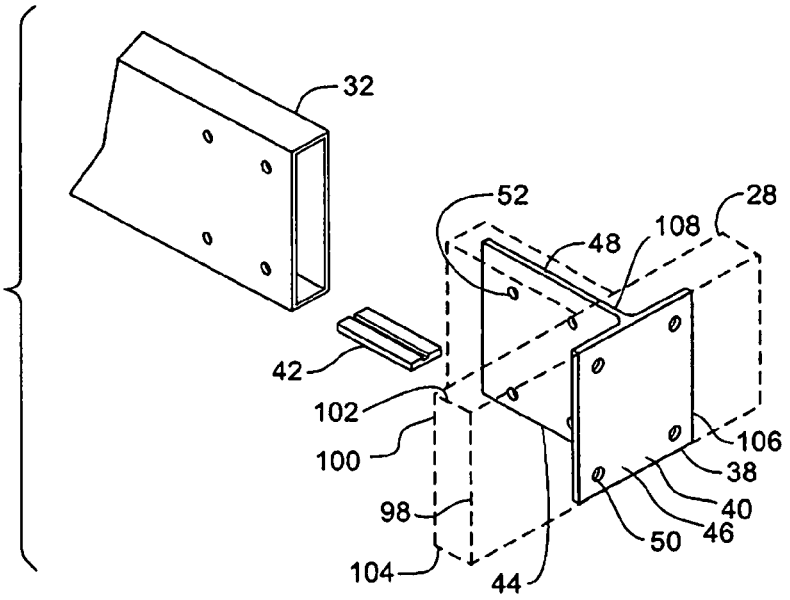
FIG. 3 is a partially phantom, partially exploded perspective view of a tube structure and mounting bracket according to an example embodiment of the invention.
Figure 4:
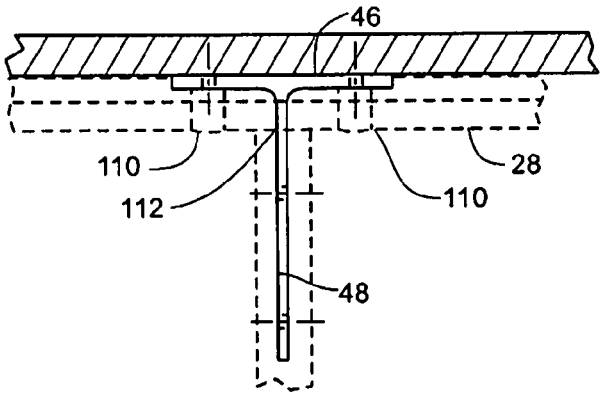
FIG. 4 is a partially phantom view of the structures depicted in FIG. 3.
Figure 5:
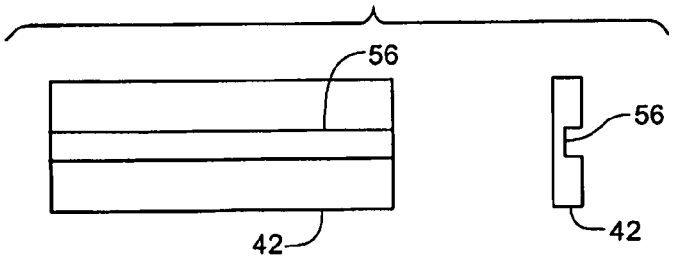
FIG. 5 is a plan view and elevational view of a spacer according to an example embodiment of the invention.

Referring particularly to FIGS. 3-5, according to an example embodiment, center mounting structure 38 generally includes mounting bracket 40 and spacer 42. In the depicted example embodiment, spacer 42 removably engages mounting bracket 40 at a lower edge 44 thereof. Mounting bracket 40 engages back tube 28 as well as center tube 32 in addition to spacer 42.

Mounting bracket 40 generally includes flange portion 46 and web portion 48. In the depicted embodiment, flange portion 46 is generally quadrilateral in structure and is pierced by flange mounting holes 50. Web portion 48 extends outwardly away from flange portion 46 generally at an approximately right angle. Flange portion 46 and web portion 48 may be formed as a unitary, for example extruded, structure. Web portion 48 in the depicted embodiment is a generally quadrilateral structure pierced by web fastener holes 52.

Referring particularly to FIGS. 3 and 5, spacer 42 is a generally rectangular structure having spacer body 54 defining web receiving slot 56 therein. In the depicted embodiment, web receiving slot 56 runs longitudinally along spacer body 54. Web receiving slot 56 is sized and shaped to receive web portion 48 at least partially therein. Spacer body 54 is sized and shaped to fit within center tubes 32 in close fitting apposition to the interior thereof. Web portion 48 is sized and shaped to be received within center tube 32 in close fitting apposition when combined with spacer 42 at a lower edge 44 thereof.

Mounting bracket 40 may be formed for example of metal such as steel or aluminum. In one example embodiment, spacer 42 is formed of a material similar to mounting bracket 40 though this should not be considered limiting.

Figure 6:
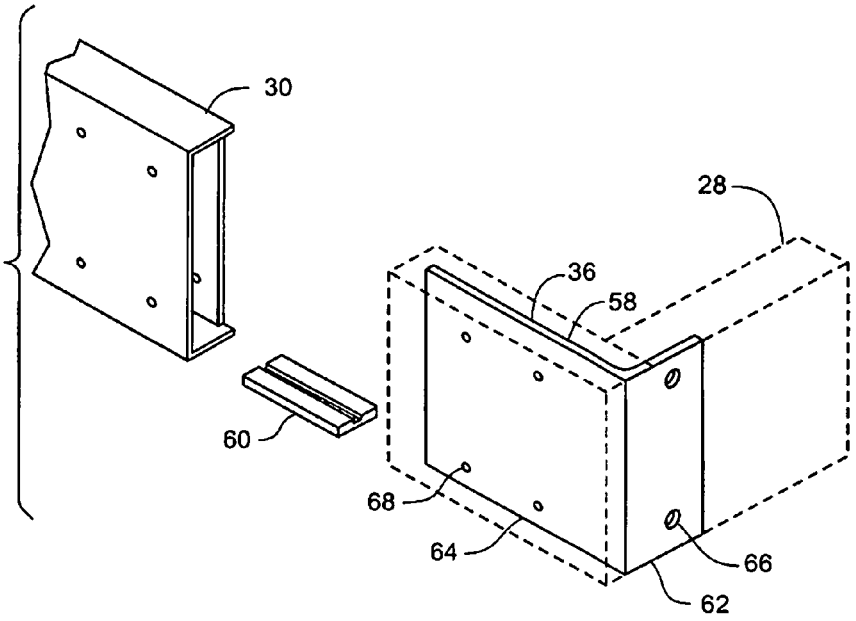
FIG. 6 is a partially phantom, partially exploded view of an end bracket and related tubular structures according to an example embodiment of the invention.
Figure 7:
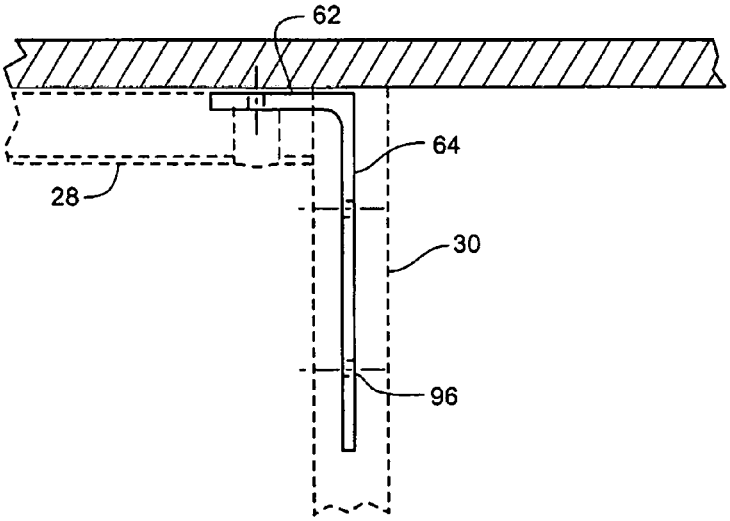
FIG. 7 is a plan view of the end bracket as depicted in FIG. 6.

Referring now to FIGS. 6 and 7, end mounting structure 36 is depicted. End mounting structure 36 generally includes end mounting bracket 58 and end spacer 60.

End mounting bracket 58 generally includes end flange portion 62 and end web portion 64. End mounting bracket 58 is a generally unitary structure and can be formed from an extrusion such as an appropriate sized angle. End mounting bracket 58 may also be a fabricated structure or may be formed from several pieces of material. End flange portion 62 is pierced by end flange mounting holes 66. End web portion 64 is pierced by end web fastener holes 68. End web portion 64, when combined with end spacer 60 is sized to fit in close fitting apposition within end tube 30. End spacer 60 is sized to fit within end tube 30 horizontally.

Figure 8:
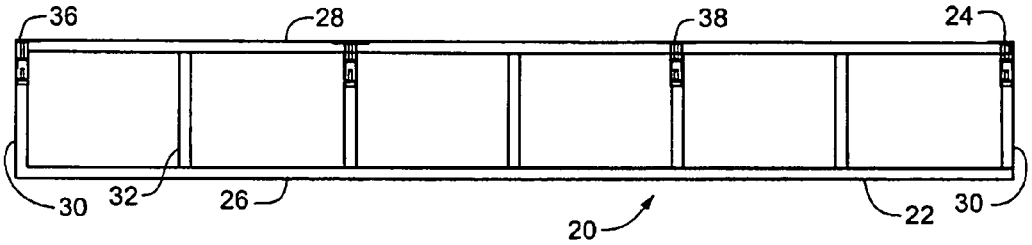
FIG. 8 is a plan view of a trellis system according to another example embodiment of the invention.
Figure 9:
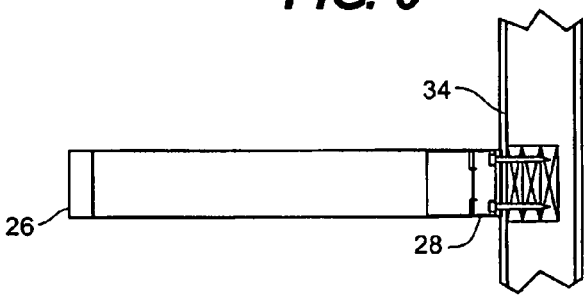
FIG. 9 is an elevational view of the trellis system depicted in FIG. 8.

Referring to FIGS. 8 and 9, another embodiment of trellis system 20 is depicted. According to this further example embodiment, trellis system 20, similar to the previously described embodiment includes frame structure 22 and mounting structures 24. Frame structure 22 is similar in that it includes front tube 26, back tube 28, end tubes 30 and center tubes 32. Similar to the earlier described embodiment, mounting structures 24 are secured to vertical structure 34 adjacent and/or within back tube 28.

Referring to FIGS. 10-13, an example embodiment of top plate mounting bracket 70 and top plate end mounting bracket 72 are depicted.

Figure 10:
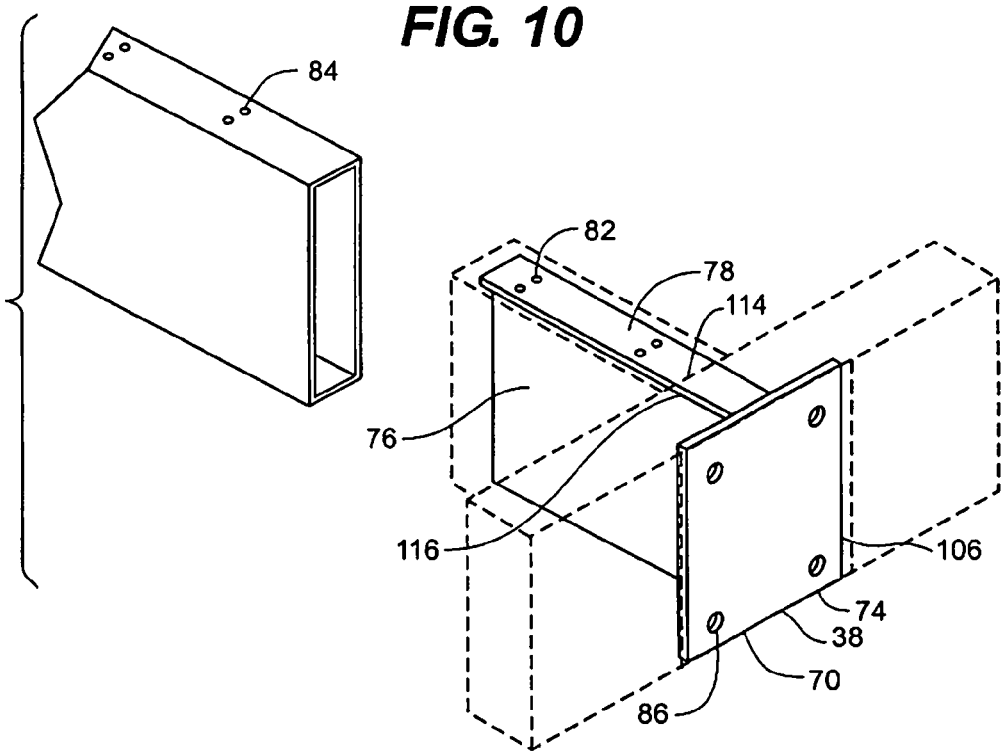
FIG. 10 is a partially exploded, partially phantom perspective view of a mounting bracket according to another example embodiment of the invention.
Figure 11:
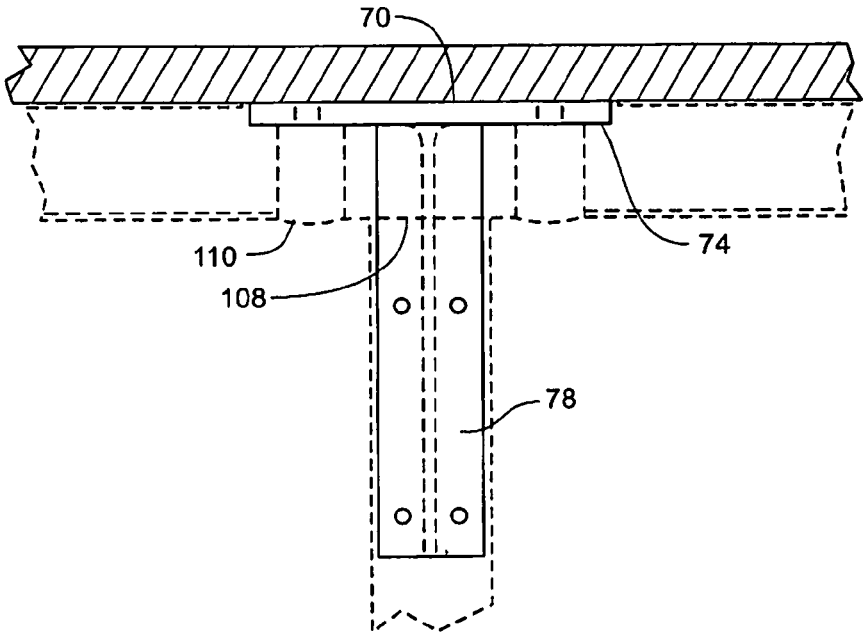
FIG. 11 is a plan view of the mounting bracket of FIG. 10.

Referring to FIGS. 10 and 11, top plate mounting bracket 70 is a generally unitary structure including flange portion 74, web portion 76 and top plate portion 78. Flange portion 74 and web portion 76 are similar in structure to flange portion 46 and web portion 48 described above. Top plate portion 78 is coupled to the top of flange portion 74 and web portion 76 generally by welding. However, top plate portion 78 may be coupled to flange portion 74 and web portion 76 by other techniques. Flange portion 74 presents flange mounting holes 80 that are configured to receive fasteners (not depicted). Unlike web portion 48, web portion 76 is not pierced by holes in this depicted embodiment. In some applications web portion 76 may be pierced by holes to receive fasteners for coupling as well as top plate portion 78. Top plate portion 78 presents top mounting holes 82. In the depicted embodiment, center tube 32 includes corresponding center tube mounting holes 84.

Figure 12:
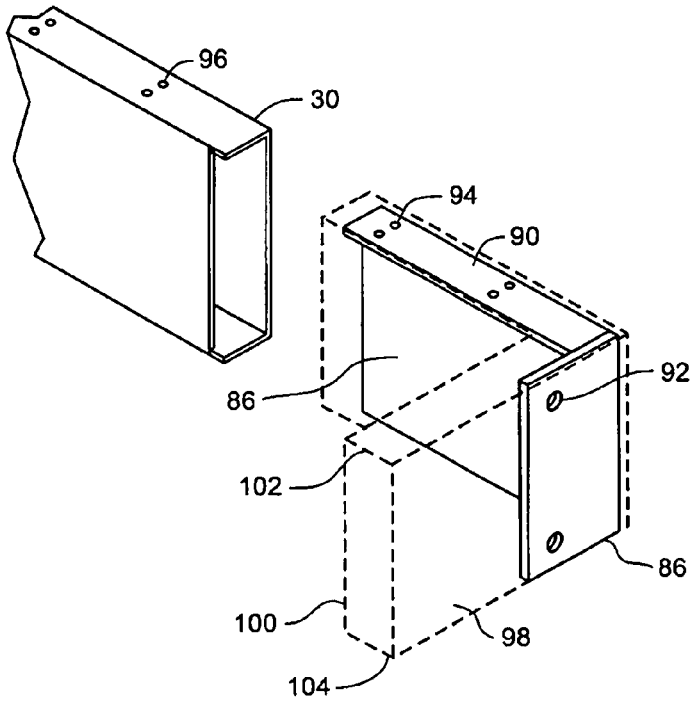
FIG. 12 is a partially exploded, partially phantom perspective view of an end mounting bracket according to another embodiment of the invention.
Figure 13:
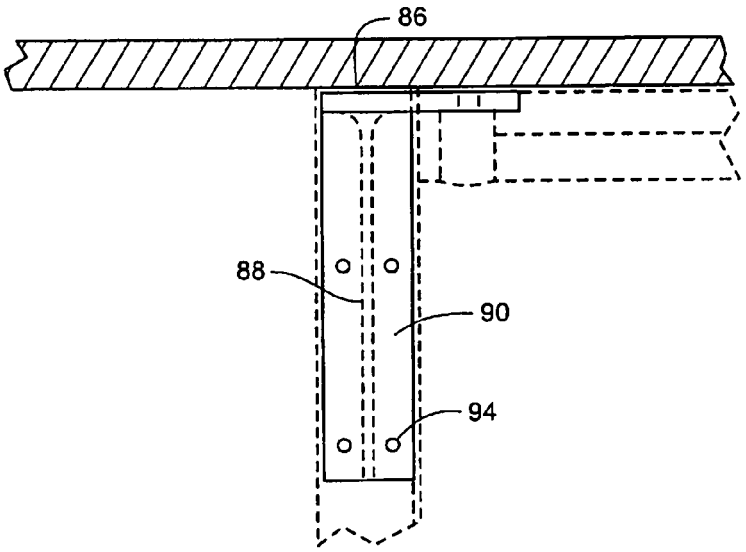
FIG. 13 is a plan view of the structure as depicted in FIG. 12.

Referring to FIGS. 12 and 13, top plate end mounting brackets 72 generally includes end flange portion 86, end web portion 88 and end top plate portion 90. End web portion 88 and end top plate portion 90 are similar in structure to end web portion 64 and end flange portion 62 as discussed above. End top plate portion is secured to the top of end web portion and end flange portion for example, by welding, though other securing techniques may be utilized. End flange portion 86 presents end flange fastener holes 92. End top plate portion 90 presents end top mounting holes 94. End top plate portion 90 and end web portion 98 are sized to fit into end tube 30 in close fitting apposition. End tube 30 presents corresponding end tube mounting holes 96. Referring now to FIGS. 3 and 4, back tube 28 is a generally rectangular structure in section and presents back wall 98, front wall 100, top wall 102 and bottom wall 104.

Back wall 98 presents and defines flange opening 106. Flange opening 106 is sized to receive flange portion 46 or flange portion 74 therethrough. Front wall 100 presents and defines web opening 108 therethrough. Web opening 108 is sized and shaped as a generally vertical slot to receive web portion 48 therethrough or, in the case of top plate mounting bracket 70, to receive web portion 76 and top plate portion 78 therethrough. In this case, web opening 108 includes vertical slot portion 114 and horizontal slot portion 116. This is depicted in FIG. 10.

Referring to FIGS. 4 and 11, front wall 100 further presents and defines fastener openings 110 therethrough. Fastener openings 110 are positioned to align substantially with flange mounting holes 50 and flange mounting holes 80. Fastener openings 110 are sized and shaped to receive fasteners (not depicted) as well as a wrench such as a socket wrench (not depicted).

According to another embodiment of the invention, the invention further includes a method of installing a trellis structure 22. The method includes securing at least one internal mounting bracket 42 to a vertical structure 34 by securing flange portion 46 of mounting bracket 42 to vertical structure 34 with fasteners (not shown) such that web portion 48 of mounting bracket 40 extends outwardly, orthogonally from flange portion 46 and from vertical structure 34.

The method further includes placing back tube 28 over mounting bracket 40 such that web portion 48 extends outwardly through web opening 108 in front wall 100. Flange portion 46 is received in a flange opening 106 in back wall 98 of back tube 28. Flange opening 106 is sized to receive the flange portion 46 therein.

The method further includes securing at least one center tube 32 extending outwardly relative to back tube 28. Center tube 32 is coupled to web portion 48 by fasteners (not shown).

The method further includes placing spacer 42 or top plate portion 78 within center tube 32 in close fitting relation to the interior of center tube 32.

According to another example embodiment of the invention, mounting bracket 40 is utilized along with spacer 42.

According to an alternative example embodiment of the invention, mounting bracket 40 includes top plate portion 78 integrally formed therewith or secured thereto.

According to another example embodiment of the method, web receiving slot 56 is formed to be a vertical slot sized to receive web portion 48 therethrough.

According to another example embodiment of the method, web receiving slot 56 includes a vertical slot portion and a horizontal slot portion sized and shaped to receive top plate portion 78 therethrough.

According to another example embodiment, the method further includes securing at least one end mounting bracket 58 to at least one end tube 30 wherein end mounting bracket 58 includes an integral structure having end flange portion 86 and end web portion 88.

According to another example embodiment, the method further includes coupling structurally separate end spacer 62 to end web portion 88 at a bottom edge thereof.

According to another example embodiment, the method further includes securing end top plate portion 92 end web portion 88.

In operation, trellis system 20 is mounted to vertical structure 34 by securing mounting brackets 40 and end mounting brackets 58 spaced at appropriate distances. The same is true of top plate mounting bracket 70 and top plate end mounting bracket 72. Back tube 28 is then placed over mounting bracket 40 and mounting bracket 58 or top plate mounting bracket 70 and top plate end mounting bracket 72 so that flange opening 106 and web opening 108 align with the appropriate brackets. Once center mounting structures 38 are secured to the wall with fasteners (not depicted), center tubes 32 may be placed over center mounting structures 38 and secured thereto with fasteners. In doing so, mounting bracket 40 and spacer 42 are placed within center tubes 32. End tubes 30 are then placed over end mounting bracket 48 or top plate end mounting bracket 72 and secured thereto with fasteners. Front tube 26 is then secured to back tubes 28 and end tubes 30.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A trellis system comprising:

a trellis structure that is installable to extend generally outwardly from a vertical supporting member;

the trellis structure comprising:

a back tube structure, the back tube structure including a tube of quadrilateral cross section having a front wall and a back wall;

a plurality of outwardly extending tube structures that are oriented to extend outwardly relative to the back tube structure including at least one end tube;

at least one internal mounting bracket by which the trellis structure is securable to the vertical supporting member;

the at least one internal mounting bracket comprising a unitary member having a flange portion and a web portion, the flange portion being securable to the vertical supporting member by fasteners and the web portion extending outwardly orthogonally from the flange portion and being couplable to one of the plurality of outwardly extending tube structures;

the back wall of the back tube structure presenting a flange opening therein sized to receive the flange portion therethrough;

the front wall of the back tube structure presenting a front opening therein sized to receive the web portion therethrough;

wherein the web portion passes outwardly through the front opening;

the web portion further comprising an alignment structure sized to be received within one of the outwardly extending tube structures in close fitting relation to an interior of the outwardly extending tube structure.

2. The trellis system as claimed in claim 1, wherein the alignment structure further comprises a structurally separate spacer engageable to the web portion at a bottom edge thereof.

3. The trellis system as claimed in claim 1, the alignment structure further comprises a top plate portion secured to the web portion.

4. The trellis system as claimed in claim 3, wherein the front opening comprises a vertical slot portion sized to receive the web portion therethrough.

5. The trellis system as claimed in claim 3, wherein the front opening comprises a vertical slot portion sized to receive the web portion therethrough and a horizontal a slot portion sized and shaped to receive the top plate portion therethrough.

6. The trellis system as claimed in claim 1, further comprising at least one end mounting bracket engageable to the at least one end tube, the at least one end mounting bracket comprising an integral structure having an end flange portion and end web portion.

7. The trellis system as claimed in claim 6, wherein the at least one end mounting bracket further comprises a structurally separate spacer engageable to the end web portion at a bottom edge thereof.

8. The trellis system as claimed in claim 6, wherein the at least one end mounting bracket further comprises a top plate portion secured to the end web portion.

9. A method of installing a trellis structure, the method comprising:

securing at least one internal mounting bracket to a vertical supporting member by securing a flange portion of the internal mounting bracket to the vertical supporting member with fasteners such that a web portion of the internal mounting bracket extends outwardly, orthogonally from the flange portion and from the vertical supporting member;

placing a back tube structure over the internal mounting bracket such that the web portion of the internal mounting bracket extends outwardly through a front opening in a front wall of the back tube structure that is sized and shaped to receive the web portion therethrough, and the flange portion of the internal mounting bracket is received in a flange opening in a back wall of the back tube structure that is sized to receive the flange portion therein;

securing, with fasteners, at least one outwardly extending tube structure, extending outwardly relative to the back tube structure and to the web portion of the internal mounting bracket; and placing an alignment structure that is coupled to or coupleable to the web portion within the at least one outwardly extending tube structure in close fitting relation to an interior of the at least one outwardly extending tube structure.

10. The method as claimed in claim 9, further comprising selecting the at least one internal mounting bracket such that the alignment structure is a structurally separate spacer engageable to the web portion at a bottom edge thereof.

11. The method as claimed in claim 9, further comprising selecting the at least one internal mounting bracket such that the alignment structure comprises a top plate portion secured to the web portion.

12. The method as claimed in claim 11, further comprising forming the front opening to be a vertical slot and to have a horizontal slot portion sized and shaped to receive the top plate portion therethrough.

13. The method as claimed in claim 9, further comprising forming the front opening to be a vertical slot sized to receive the web portion therethrough.

14. The method as claimed in claim 9, further comprising securing at least one end mounting bracket to at least one end tube, the end mounting bracket comprising an integral structure having an end flange portion and end web portion.

15. The method as claimed in claim 14, further comprising coupling a structurally separate spacer to the end web portion of the end mounting bracket at a bottom edge thereof.

16. The method as claimed in claim 14, further comprising securing an end top plate portion to the end web portion of the end mounting bracket.

* * * * *